US006631828B1

(12) United States Patent
Reardon

(10) Patent No.: US 6,631,828 B1
(45) Date of Patent: Oct. 14, 2003

(54) GOLF BALL AND TEE PLACEMENT UNIT

(76) Inventor: Trisha Reardon, 303 Ravenwood Way, South San Francisco, CA (US) 94080

( * ) Notice: Subject to any disclaimer, the term of this patent is extended or adjusted under 35 U.S.C. 154(b) by 36 days.

(21) Appl. No.: 10/055,840

(22) Filed: Jan. 23, 2002

(51) Int. Cl.[7] ..... B65G 59/00
(52) U.S. Cl. ..... 221/268; 473/135
(58) Field of Search ..... 221/258, 268, 221/270, 278, 289; 473/174, 131, 132, 135, 137

(56) References Cited

U.S. PATENT DOCUMENTS

| | | | |
|---|---|---|---|
| 1,868,261 | A | 7/1932 | Spencer |
| 1,937,180 | A | 11/1933 | Young |
| 2,071,356 | A | 2/1937 | Pagett |
| 2,171,299 | A | 8/1939 | Beckett |
| 3,003,770 | A | 10/1961 | Jones |
| 3,458,204 | A | 7/1969 | Wilson |
| 3,599,983 | A | 8/1971 | Melton |
| 3,738,662 | A | 6/1973 | Hodgin |
| 4,265,453 | A | 5/1981 | Loof |
| 4,796,893 | A | 1/1989 | Choi |
| 5,326,107 | A | 7/1994 | Park |
| 5,464,223 | A | 11/1995 | Dermott |
| 5,549,518 | A | 8/1996 | Wang |
| 5,582,325 | A | 12/1996 | Janier |

*Primary Examiner*—Kenneth W. Noland
(74) *Attorney, Agent, or Firm*—Michael I. Kroll

(57) ABSTRACT

The present invention 10 discloses a golf/tee placement device having a housing 32 having a hopper 18 therein for the placement of a plurality of golf balls 14 and a canister for the placement of a plurality of tees 16. The housing uses compressed air to move a golf ball 14 and golf tee 16 away from the device and drive the tee 16 into the ground with the golf ball 14 placed thereon. Positioned on the exterior face of the housing 32 is a control panel 26 with user selectable variables such as the depth of the golf tee and the time duration for the placement of subsequent balls and tees. The device moves a tee 16 into the extending placement arm 22 using compressed air. In conjunction with the loading of the tee 16 a single ball 14 is released into the placement arm 22. Once positioned the placement arm 22 uses compressed air to extend it to full position whereupon a jet of compressed air drives the ball 14 and the tee 16 into the ground while opening the hinged element which retracts leaving the golf ball 14 and implanted tee 16 behind.

12 Claims, 14 Drawing Sheets

GOLF BALL AND TEE PLACEMENT UNIT

BACKGROUND OF THE INVENTION

1. Field of the Invention

The present invention relates generally to sporting equipment and, more specifically, to a golf ball/tee placement device. The golf/tee placement device is comprised of a housing having a hopper for the placement of a plurality of golf balls and a canister for the placement of a plurality of tee. The housing uses compressed air to move a golf ball and golf tee away from the device and drive the tee into the ground with the golf ball placed thereon.

The golf/tee placement device can be used as a portable device having enough compressed air for the placement of approximately 200 golf balls and tees. The number of placements is a variable of the user selectable setting on the depth of the placement of the golf tee.

Positioned on the exterior face of the housing is a control panel with user selectable variables such as the depth of the golf tee, the time duration for the placement of subsequent balls and tees.

The device can also be used to place golf balls without tees by leaving the tee canister empty. The device moves a tee into the extending placement arm using compressed air. In conjunction with the loading of the tee a single ball is released into the place arm. Once positioned the placement arm using compressed air extends to its full position whereupon a jet of compressed air drives the ball and tee into the ground while opening the hinged element which retracts leaving the golf ball and implanted tee behind.

The device can also be connected to a compressor having unlimited placement of golf tees and/or golf balls.

The device of the present invention provides a carrying strap for easy maneuvering and holding.

2. Description of the Prior Art

There are other golf/tee device designed for delivery of a golf ball. Typical of these is U.S. Pat. No. 1,868,261 issued to Spencer on Jul. 19, 1932.

Another patent was issued to Young on Nov. 28, 1933 as U.S. Pat. No. 1,937,180. Yet another U.S. Pat. No. 2,071,356 was issued to Pagett on Feb. 23, 1937 and still yet another was issued on Aug. 29, 1939 to Beckett as U.S. Pat. No. 2,171,299. Another patent was issued to Jones on Oct. 10, 1961 as U.S. Pat. No. 3,003,770. Yet another U.S. Pat. No. 3,458,204 was issued to Wilson on Jul. 29, 1969. Another was issued to Melton on Aug. 17, 1971 as U.S. Pat. No. 3,599,983 and still yet another was issued on Jun. 12, 1973 to Hodgin as U.S. Pat. No. 3,738,662.

Another patent was issued to Loof on May 5, 1981 as U.S. Pat. No. 4,265,453. Yet another U.S. Pat. No. 4,796,893 was issued to Choi on Jan. 10, 1989. Another was issued to Park on Jul. 5, 1994 as U.S. Pat. No. 5,326,107 and still yet another was issued on Nov. 7, 1995 to Dermott as U.S. Pat. No. 5,464,223.

Another patent was issued to Wang on Aug. 27, 1996 as U.S. Pat. No. 5,549,518. Yet another U.S. Pat. No. 5,582,325 was issued to Janier on Dec. 10, 1996.

U.S. Pat. No. 1,868,261

Inventor: Clyde Spencer

Issued: Jul. 19, 1932

The invention discloses an apparatus of the character described having the combination of a chute for holding a series of golf balls in position to roll toward one end thereof, a flexible guide at the latter end of said chute for positioning a ball for driving, said guide serving to conduct the balls one at a time by gravity to said driving position and means for controlling the delivery of the balls to said guide.

U.S. Pat. No. 1,937,180

Inventor: Leonard A. Young

Issued: Nov. 28, 1933

Disclosed is a golf ball teeing device, the combination with a base, of a hopper having a laterally disposed portion at its lower end, a yoke shaped hopper supporting bracket on said base disposed to embrace the laterally disposed bottom portion of said hopper, an actuating lever pivotally mounted on said bracket, and gate members connected to said lever on opposite sides of its pivot.

U.S. Pat. No. 2,071,356

Inventor: William P. Pagett

Issued: Feb. 23, 1937

An automatic golf ball feeding and teeing device, a spirally descending magazine having an outer and an inner vertical cylinder, a tee pivotally mounted on the magazine, delivery means mounted on the magazine for successively delivering said golf balls to the tee, comprising a weighted delivery trough suspended at one end by a hinge bearing subjacently at right angles to the discharge end of said magazine, and curving abruptly upward through a slotted opening in said outer vertical cylinder, and merging into a straight upwardly extending portion, and having at its outer end an integral annular delivery guide with an opening therethrough to permit the downward passage of a golf ball, said delivery trough being counter-weighted at its bearing end to hold it normally in said upwardly extending position, whereby the trough will be caused to swing downward and register the delivery guide with the tee when overbalanced by the weight of a golf ball delivered from said magazine to the bearing end of said delivery trough, and means operably connected to the inner end of said tee, and operated by each vertical reciprocation thereof, whereby one ball at a time is fed from the magazine to the tee, upon each vertical reciprocation of the tee, said reciprocation being caused by golf ball weight successively applied to and removed from the tee.

U.S. Pat. No. 2,171,299

Inventor: Clay C. Beckett

Issued: Aug. 29, 1939

The invention is a golf teeing machine comprising a shallow casing having an upstanding side wall and a cone-shaped bottom, a hand operable lever pivotally mounted on said casing and extending through said bottom at the apex thereof, said lever being arranged extending vertically above said side wall to a height convenient for hand operation, said side wall being provided with means defining an outlet for golf balls, a chute movable to guide balls leaving the outlet, and link means connecting said lever with said chute for movement of said chute by said lever.

U.S. Pat. No. 3,003,770

Inventor: Richard O. Jones

Issued: Oct. 10, 1961

In a golf ball teeing device, a vertical golf ball supply chamber formed at its lowest portion with a delivery aperture, a generally L-shaped trough pivoted in said aperture and extending therethrough, means biasing said trough to a position wherein its outer portion is elevated, a guide channel in the chamber inclined downwardly toward and registerable with the inner portion of said trough when the outer portion of the trough is elevated, a tee lever pivotally mounted below the trough in the same vertical plane therewith, an upstanding tee on the outer end of the tee lever, ball-positioning means on the outer end of the trough is swung downwardly, a feeding roller rotatably mounted in the chamber and spaced above said guide channel by a distance substantially equal to the diameter, of a golf ball, projections on the feeding roller spaced to receive therebetween a golf ball in the channel to prevent descent thereof, said trough being rotatable to lower its outer portion by gravity towards the tee lever responsive to the entry of a golf ball into its inner portion, upstanding rod means connected to the tee lever on one side of its pivotal connection and located to drivingly engage with the feeding roller responsive to downward rotation of the outer end of the tee lever caused by the weight of a golf ball on the tee lever, additional upstanding rod means connected to the tee lever on the opposite side of its pivotal connection and normally lockingly engaging the feeding roller, and means retracting said last-named rod means from the feeding roller responsive to said downward rotation of said outer end of the tee lever, whereby to provide an escapement action between the tee lever and the feeding roller.

U.S. Pat. No. 3,458,204

Inventor: James B. Wilson

Issued: Jul. 29, 1969

The invention is a golf ball feeding and ball retriever means comprising an elongated storage tube having an inner diameter not substantially greater than a golf ball for picking up and housing a supply of golf balls U.S. Pat. No. 3,599,983

Inventor: Raymond L. Melton

Issued: Aug. 17, 1971

A golf ball dispenser disclosed herein having a hopper for storing a quantity of balls and a pivoting ramp mounted on a fulcrum base for receiving a ball from the hopper for delivering to a playing tee. The device includes a selector means for introducing one ball at a time to the ramp and the end of the ramp mounts a helical guide for placing the selected ball directly onto the tee. Counterweights are carried on the ramp to an upright position out of the club-swinging path.

U.S. Pat. No. 3,738,662

Inventor: Charles L. Hodgin

Issued: Jun. 12, 1973

An automatic golf ball teeing device is provided having a frame and a ball guide tube mounted on the frame to which a portable ball storage rack may be attached to feed golf balls to the guide tube; a cup is attached to a pivotally movable transfer arm having a counter-weight at its end opposite the cup; when the transfer arm is in a raised position the cup will cause the transfer arm to pivot downwardly to discharge the ball through an adjustable wire guide track on to a golf tee; the golf tee is supported on a member which will pivot about a horizontal axis when the tee is struck by a golf club; a rod is pivotally mounted on a support and is rigidly attached to the pivoting member and extends to the base of the frame; a star wheel feeder is rotatably mounted adjacent the ball guide tube with the spokes of the wheels projecting into the tube; a spring biased hook latch controls rotation of the star wheel and a mechanical linkage is provided to disengage the latch hook from the star wheel in response to pivoting of the rod connected to the golf ball tee supporting member so that one ball at a time can be discharged from the ball guide tube into the cup.

U.S. Pat. No. 4,265,453

Inventor: Robert H. C. Loof

Issued: May 5, 1982

A golf ball teeing apparatus to receive a ball from a magazine holding a plurality of balls and position the ball on a tee automatically upon a previous ball positioned on the tee being struck by a golf club. When a ball is driven off the tee, the tee deflects. This deflection actuates a first gate in the magazine to release one ball for movement onto a pivoted and counter weighted arm. The weight of the released ball pivots the arm to transfer that ball to the tee. At the tee, the ball rolls off the arm and the counterweight returns the arm to a position adjacent the magazine. As the arm returns to this position, it actuates a second gate in the magazine to permit one ball to move against the first gate in position to be released onto the arm when the teed ball has been driven.

U.S. Pat. No. 4,796,893

Inventor: Young S. Choi

Issued: 4,796,893

The portable golf ball-teeing device consists of a portable case, the upper portion of which opens into a hopper to receive a bucket of golf balls. The apparatus within the case for separating and singularizing the golf balls consists of a platform at the bottom of the hopper having inclined surfaces leading to a funnel shaped opening in the platform, a rotatable cup located at the bottom of the funnel to receive the golf balls singly, and three blades which are suspended for movement through slits in the platform, the blades include an outer parallel pair which move in an arcuate path and a central blade which reciprocates in a vertical path. The blades are interconnected with the cup and move in response to movement of the cup. The cup is rotated by a linear gear, meshing with gear teeth on the cup, which is actuated by a foot pedal that is connected to the gear by a wire. In operation, pressure on the foot pedal rotates the cup to release a ball from the cup down a guide connected to the cup to a tee. As the cup moves the blades also move guiding balls into single file over the platform surface into the funnel and then, the cup.

U.S. Pat. No. 5,326,107

Inventor: Hyo C. Park

Issued: Jul. 5, 1994

The invention relates to a golf ball storage and dispensing apparatus including a horizontally movable arm member. A housing covers the arm member in a retracted position and stores the golf balls above the arm member. A guide wire supports a golf ball during movement of the arm member from the housing towards the tee. When the arm member is in a fully extended position, the arm member moves over the guide wire for releasing the ball onto the tee.

U.S. Pat. No. 5.464,223

Inventor: John R. Dermott

Issued: 5,464,223

A device for teeing a golf ball automatically and in portable form. It is a complete unit consisting of a hopper for holding a plurality of balls, guides and blockers to prevent the balls clogging in the hopper, a rotor and pendulum to release one ball at a time, an automatic actuation of the ball release, a pivoting ramp to place a ball on an integral tee and a connection to the tee so that when the ball is struck with a golf club, the next ball will automatically proceed to the tee. The flow of a ball to the tee is accomplished by gravity due to the elevated hopper and the force of the golfer's swing. The device is mechanical and does not require electric power or batteries and is completely automatic since no separate operation is required to send the ball to the tee.

U.S. Pat. No. 5,549,518

Inventor: Austin Wang

Issued: 5,549,518

A golf ball dispensing device includes: a pivotal track pivotally mounted in and normally vertically erected on a housing by a pivot, a hopper fitted on the housing for loading golf balls into the housing, an unloading lever formed on a first side portion of the pivot of the pivotal track and a counterweight secured on a balancing lever formed on a second side portion of the pivot opposite to the unloading lever, and a trigger device pivotally mounted on the housing about the pivot, whereby upon a manual depression such as depressed by a golf club or driver on the trigger device to bias the unloading lever downwardly from the vertically erected position, a golf ball received on a concave portion on the rear end portion of the unloading lever will gravitationally roll down along the unloading lever to a tee to be struck by a golfer; and after discharging the golf ball from the unloading lever, the counterweight on the balancing lever will automatically restore the pivotal track vertically ready for a next teeing portion, without requiring an electric motor and power supply.

U.S. Pat. No. 5,582,325

Inventor: Jean-Louis Janier

Issued: 5,582,325

Distributor of the type comprising ball storing means and an articulated arm supplying a ball to the striking area. According to the invention, the ball storage means consists of a prismatic housing including, adjacent to each of its ends, supporting devices causing the bottom thereof to slope downwards in the direction of its open downstream end, which delimits an outlet for the passage of only one ball, its arm being articulated about a pivot pin in the housing. The distributor comprises a longitudinal chute, the upstream end being longitudinally closed, but having an opening for the distribution of a ball, while the upstream end is configured in the shape of a scoop for seizing a ball. Spring return means are placed between the housing and the arm to bring said arm into a substantially vertical position, once a ball is released.

SUMMARY OF THE PRESENT INVENTION

The present invention discloses a golf/tee placement device having a housing having a hopper therein for the placement of a plurality of golf balls and a canister for the placement of a plurality of tees. The housing uses compressed air to move a golf ball and golf tee away from the device and drive the tee into the ground with the golf ball placed thereon. Positioned on the exterior face of the housing is a control panel with user selectable variables such as the depth of the golf tee and the time duration for the placement of subsequent balls and tees. The device moves a tee into the extending placement arm using compressed air. In conjunction with the loading of the tee a single ball is released into the placement arm. Once positioned the placement arm uses compressed air to extend it to full position whereupon a jet of compressed air drives the ball and the tee into the ground while opening the hinged element which retracts leaving the golf ball and implanted tee behind.

A primary object of the present invention is to provide a device for the placement of a golf tee into the ground and a golf ball thereon.

Another object of the present invention is to provide a mechanical device for the selective placement of a single golf ball from a hopper containing a plurality of golf balls.

Yet another object of the present invention is to provide a mechanical device using compressed air to drive a golf tee into the ground.

Still yet another object of the present invention is to provide a mechanical device for the selective placement of a golf ball and tee into the ground by a user selectable time frame.

Another object of the present invention is to provide a mechanical device having an extendable retractable arm for the selective placement of a single golf ball from a hopper containing a plurality of golf balls and a tee driven into the ground.

Yet another object of the present invention is to provide a golf/tee placement device that is economical to manufacture and provides a carrying strap.

Still yet another object of the present invention is to provide a golf/tee placement device that is easy to use.

Another object of the present invention is to provide a golf/tee placement device that is portable.

Additional objects of the present invention will appear as the description proceeds.

The present invention overcomes the shortcomings of the prior art by providing a golf ball/tee placement device having a housing having a hopper for the placement of a plurality of golf balls therein and a canister for the placement of a plurality of tee whereupon the device uses compressed air to move a golf ball and golf tee away from the device and drive the tee into the ground with the golf ball placed thereon or the placement of golf balls without tees.

The device can be used as a portable device using compressed air canisters. The number of placements being a variable of the user selectable setting on the depth of the placement of the golf tee.

The device has a control panel with user selectable variables such as the depth of the golf tee and the time duration for the placement of subsequent balls and tees.

The device moves a tee into the extending placement arm using compressed air. In conjunction with the loading of the tee a single ball is released into the place arm. Once positioned the placement arm using compressed air extends to its full position whereupon a jet of compressed air drives the ball and tee into the ground while opening the hinged element which retracts leaving the golf ball and implanted tee behind.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
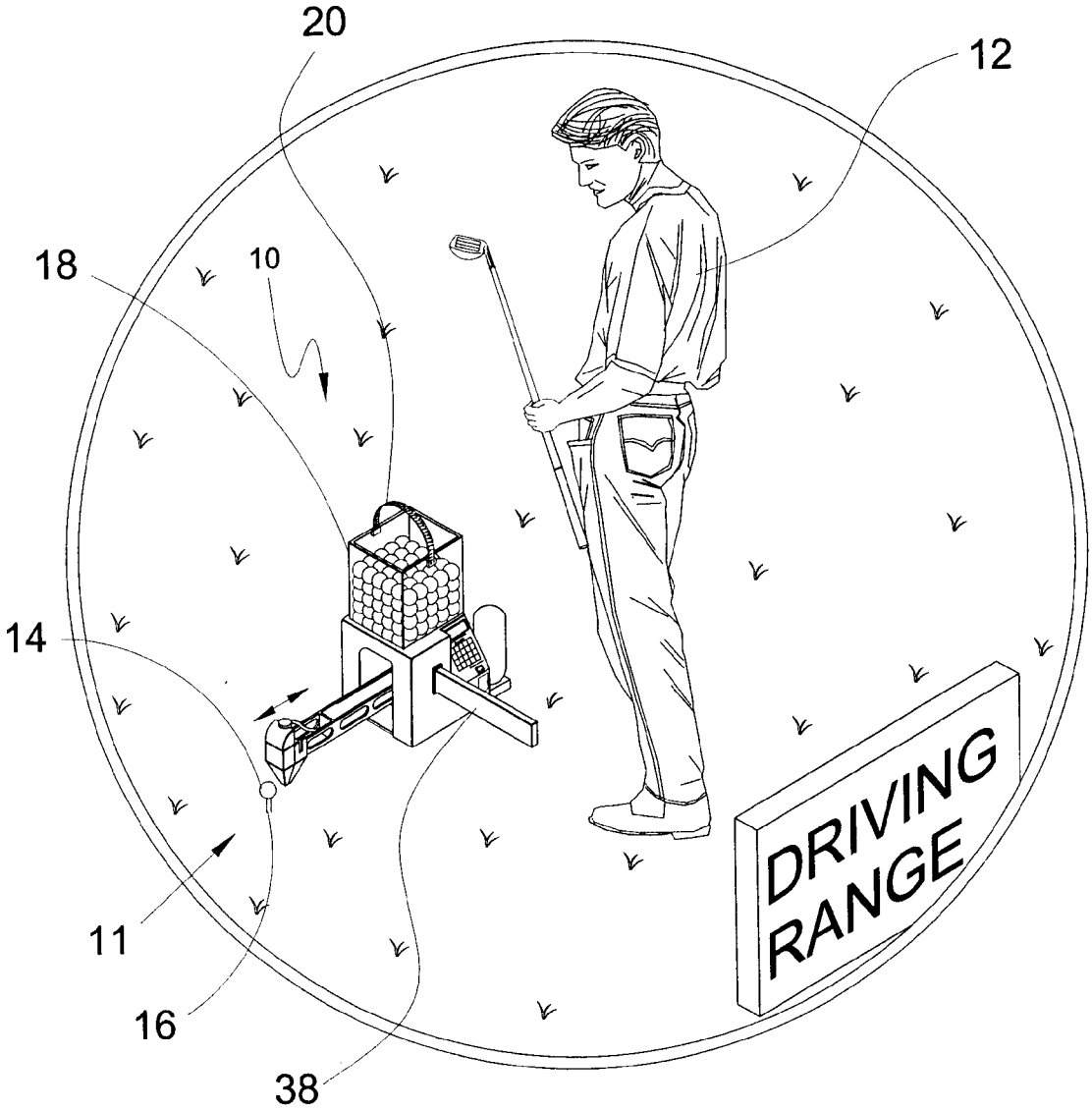
FIG. 1 is an illustrative view of the present invention in use.

With regard to reference numerals used, the following numbering is used throughout the drawings.

10 present invention
11 ground
12 user
14 golf ball
16 tee
18 ball storage unit
20 strap
22 placement arm
24 placement unit
25 aperture
26 control panel
28 on/off switch
30 air gun
32 housing
33 chute
34 battery compartment
36 main pressure tank
38 tee clip
40 arm pressure tank
42 pneumatic hinge
44 tee clip housing
46 pressure spring
48 guide track
50 pressure valve
52 stop block
54 head of tee
56 placement unit
58 guide track
60 pressure conduit
62 guides
64 pneumatic motor
66 release gate
68 air gun
70 arm guides
72 arm stop
74 pressure distributor
76 load gate
78 tension spring
80 air pressure catch
82 golf ball conduit
84 fixed member
86 retractable member
88 battery
90 timer
92 dispense ball/tee switch
94 dispense ball switch
96 display
98 attachment hardware
100 retainer for strap
102 screw

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

Turning to FIG. 1, shown therein is an illustrative view of the present invention 10. Shown is the present invention 10 being used by a golfer 12. The present invention 10 holds a large plurality of golf balls 14 in the hopper or golf ball storage unit 18, and a plurality of tees in the tee clip 38, so that when activated the present invention 10 will either drop a golf ball 14 or insert a golf ball on a tee 16 into the ground 11. The present invention 10 is a portable device and is provided with a strap 20 for easy manipulation of the device.

Figure 2:
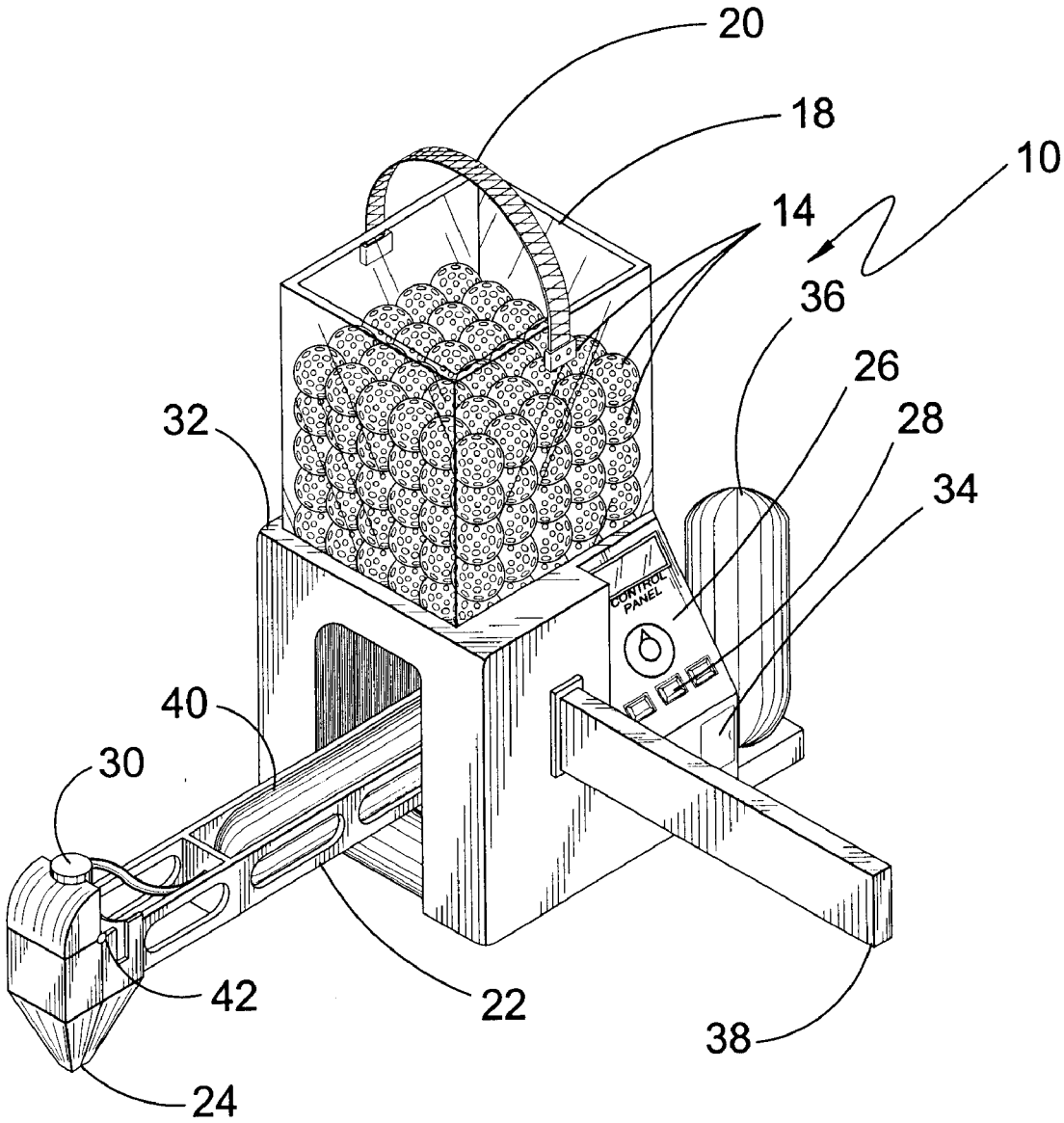
FIG. 2 is a perspective view of the present invention.

Turning to FIG. 2, shown therein is a perspective view of the present invention 10. Shown is the present invention 10 having a placement arm 22 with a placement unit 24 thereon that extends and retracts pneumatically to take a golf ball 14 from the golf ball storage unit 18 mounted on a housing 32 and place it in a desired location, or to selectively take a tee from the tee clip 38 with a golf ball and pressurize the ball on top of the tee into the ground. Also shown is a control panel 26 with on/off switch 28 to allow the user to program a desired rate of release, or to set the tee depth by regulating the pressure of the air gun 30. Also shown are a battery compartment 34, main pressure tank 36, arm pressure tank 40, and pneumatic hinge 42.

Figure 3:
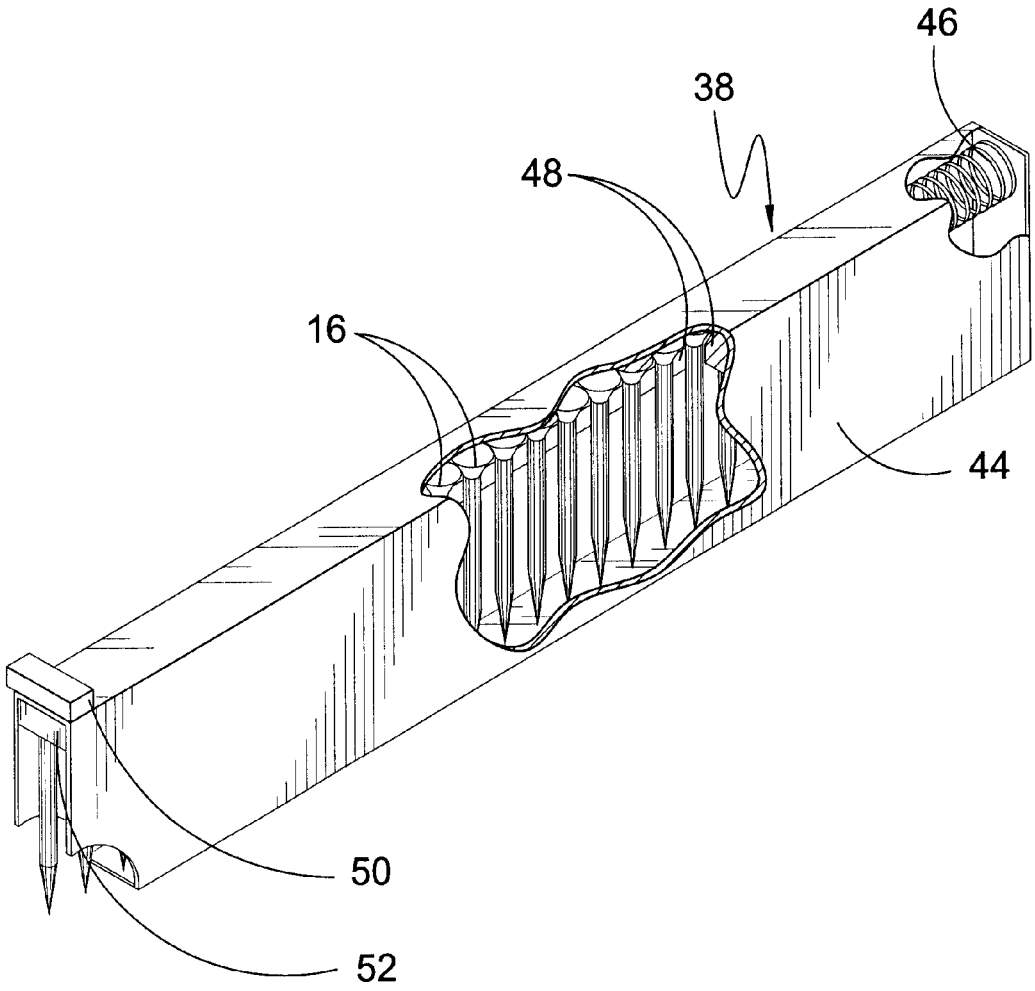
FIG. 3 is a cut away view of the tee clip.

Turning to FIG. 3, shown therein is a cut away view of the tee clip 38. Shown is the tee clip 38 having a plurality of tees 16 loaded into the elongated tee housing 44 with a pressure spring 46 therein to produce forward pressure of the tees 16 along the internal guide track 48 to displace them toward the stop block 52. Also provided is a tee injection pressure valve 50 to project the tee 16 downward into the placement unit. Guide track 48 runs longitudinally along the housing 44.

Figure 4:
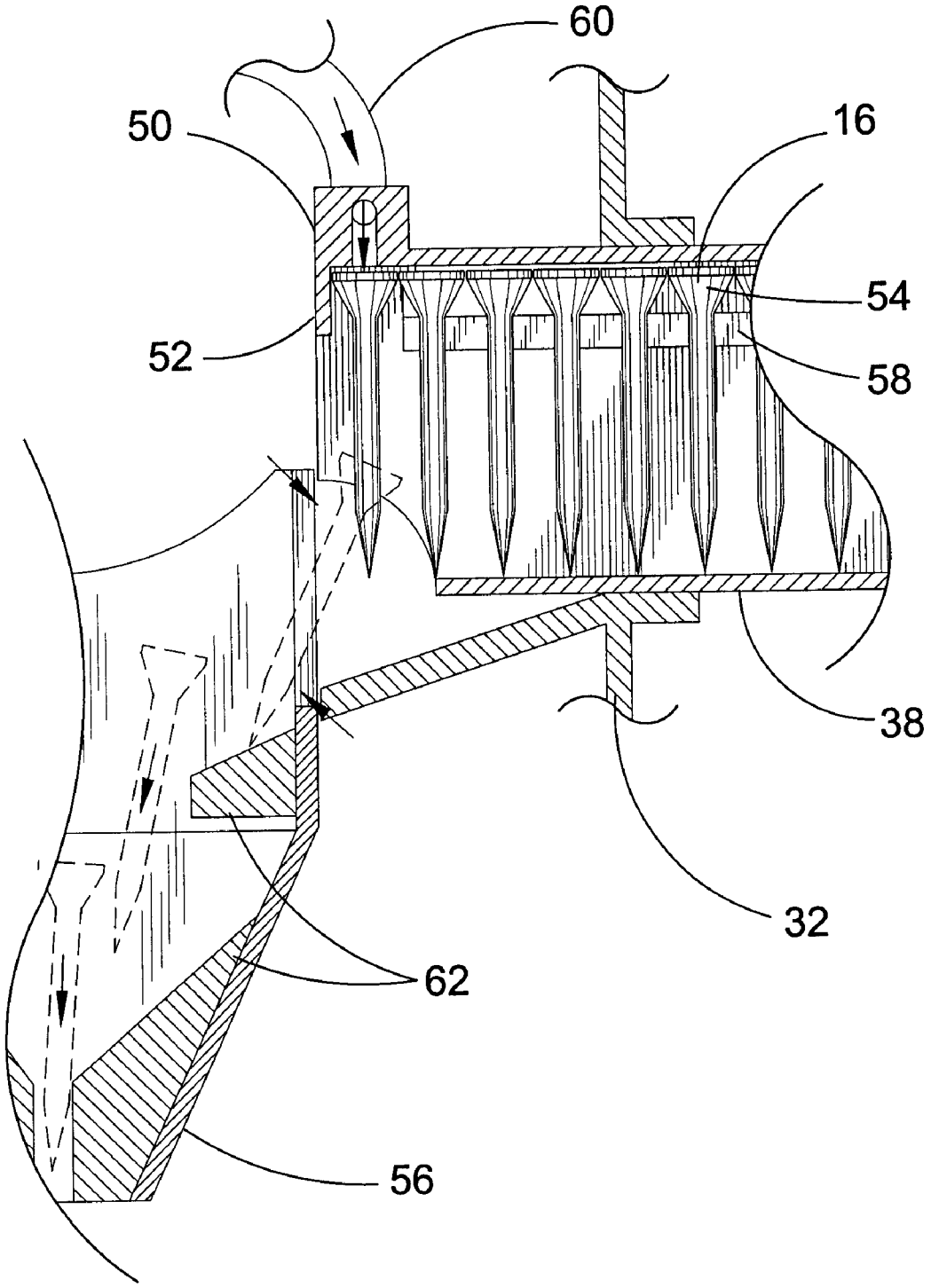
FIG. 4 is a sectional view of the present invention.

Turning to FIG. 4, shown therein is a sectional view of the present invention 10. Shown is the tee clip 38 of the present invention placed into the device housing 32 and having a pre-selected control panel pressure exerted on the tee head 54 to eject the tee 16 by overcoming the existing frictional forces exerted on the tee 16 by the pressure spring, resulting in the tee dropping into its correct position in the placement unit 56. Also shown are the guide track 58, stop block 52, pressure conduit 60, tee injection pressure valve 50, and guides 62.

Figure 5:
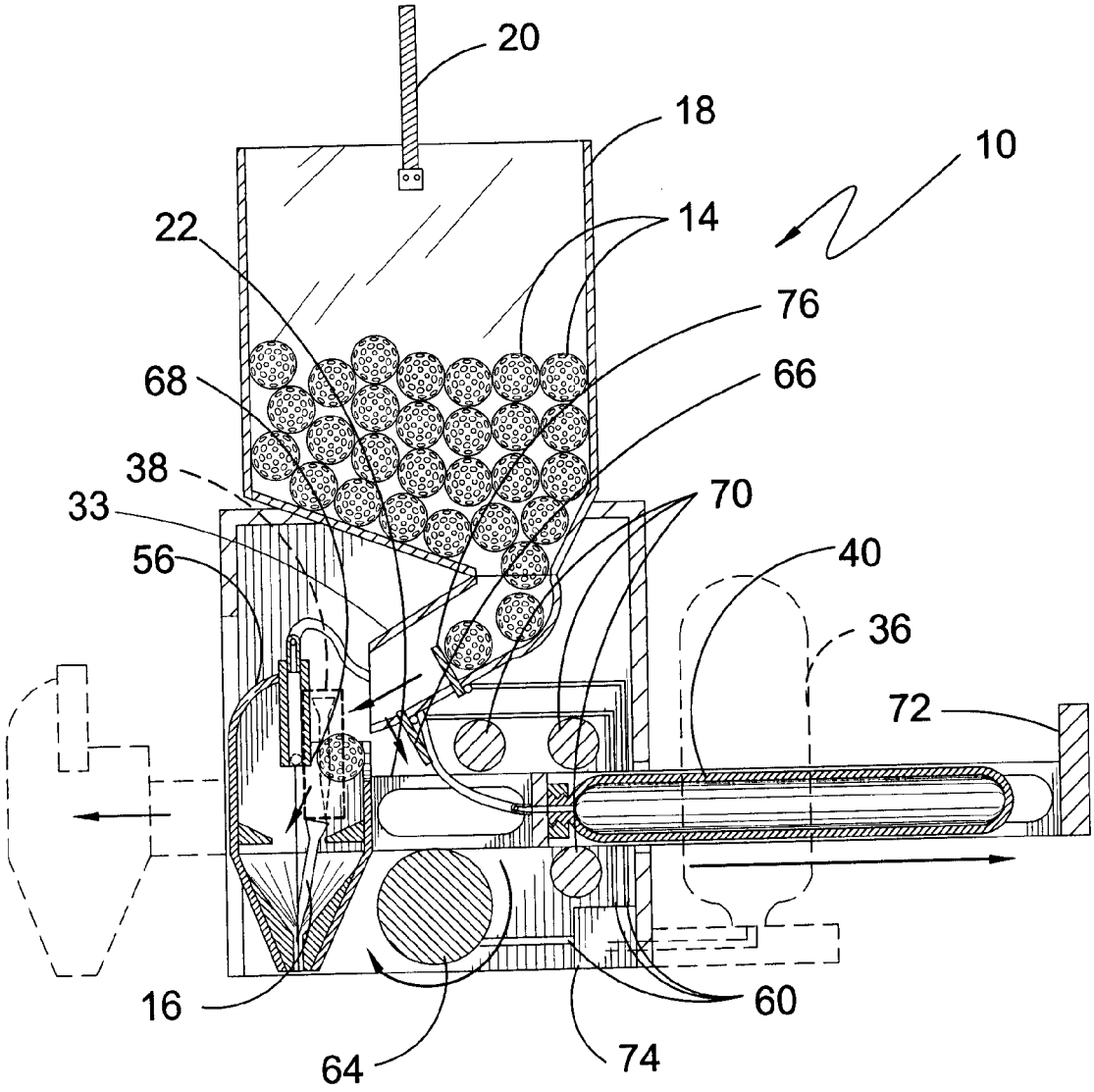
FIG. 5 is a cut away view of the present invention.

Turning to FIG. 5, shown therein is a cut away view of the present invention 10. Shown are the internal components of the present invention's housing positioning a tee 16 and golf ball 14 in the placement unit 56. The pneumatic motor 64 reciprocatingly retracts the elongated placement arm 22 where upon the tee clip 38 releases a tee 16 through air pressure into an aperture in the top of the placement unit 56 and in concert a golf ball 14 is dropped through the downwardly chute or conduit 33 by gravity by opening the release gate 66 by the application of air pressure thereto. Arm 22 reciprocates from one side of the housing to the other. Also shown are air gun 68, a plurality of arm guides 70 disposed in a spaced apart manner along the arm 22 upon which the arm 22 moves, arm stop 72, pressure distributor 74 for delivering air from the main tank 36 to the motor 64 and other parts of the present invention, load gate 76, along with other elements previously disclosed.

Figure 6:
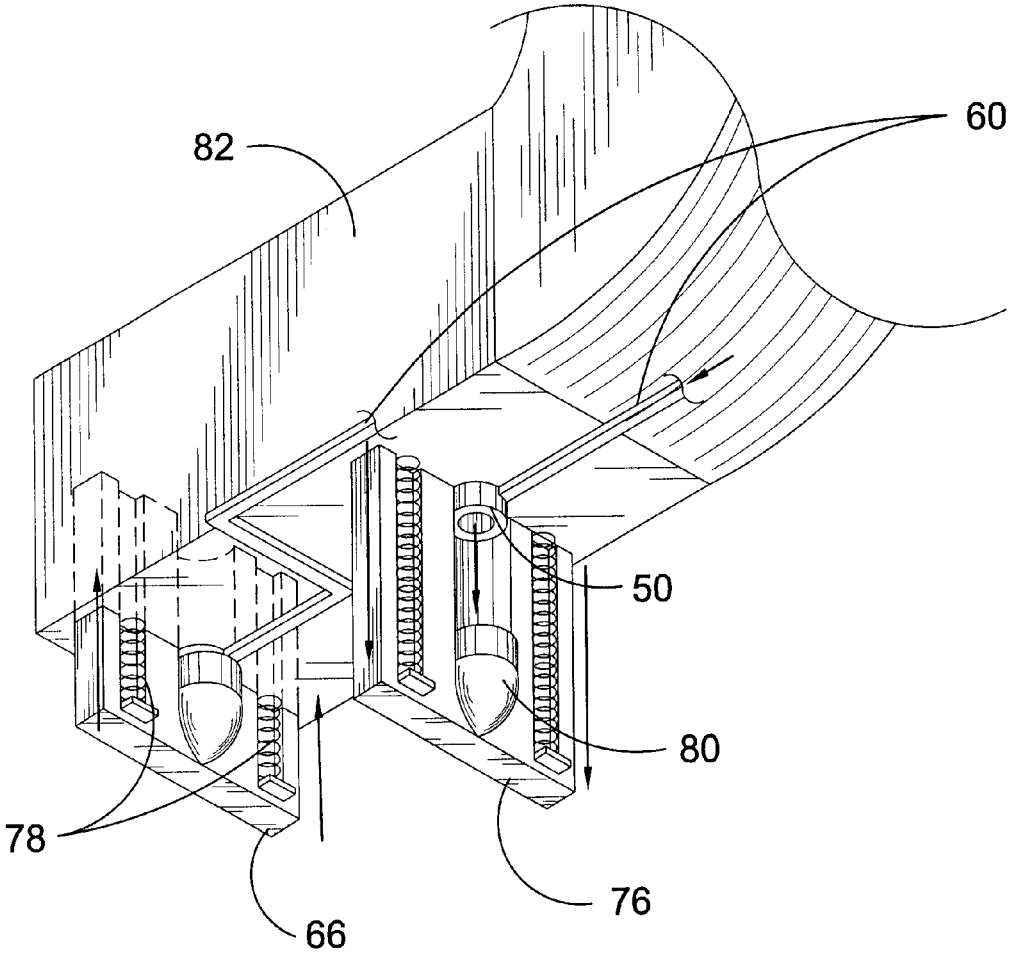
FIG. 6 is a bottom view of the present invention.

Turning to FIG. 6, shown therein is a bottom view of the present invention. Shown is the present inventions golf ball load 76 and release gates 66. The gates 66, 76 operate by applying an amount of air pressure, capable of overcoming the tension springs 78, through a pressure valve 50 that applies the pressure to an air pressure catch 80 to achieve downward motion of the gates 66, 76 to allow golf ball movement. None application of air pressure causes the gates 66, 76 to stay in an upward and closed position maintained by the tension springs 78. The pressure conduit 60 and golf ball chute or conduit 82 are also shown.

Figure 7:
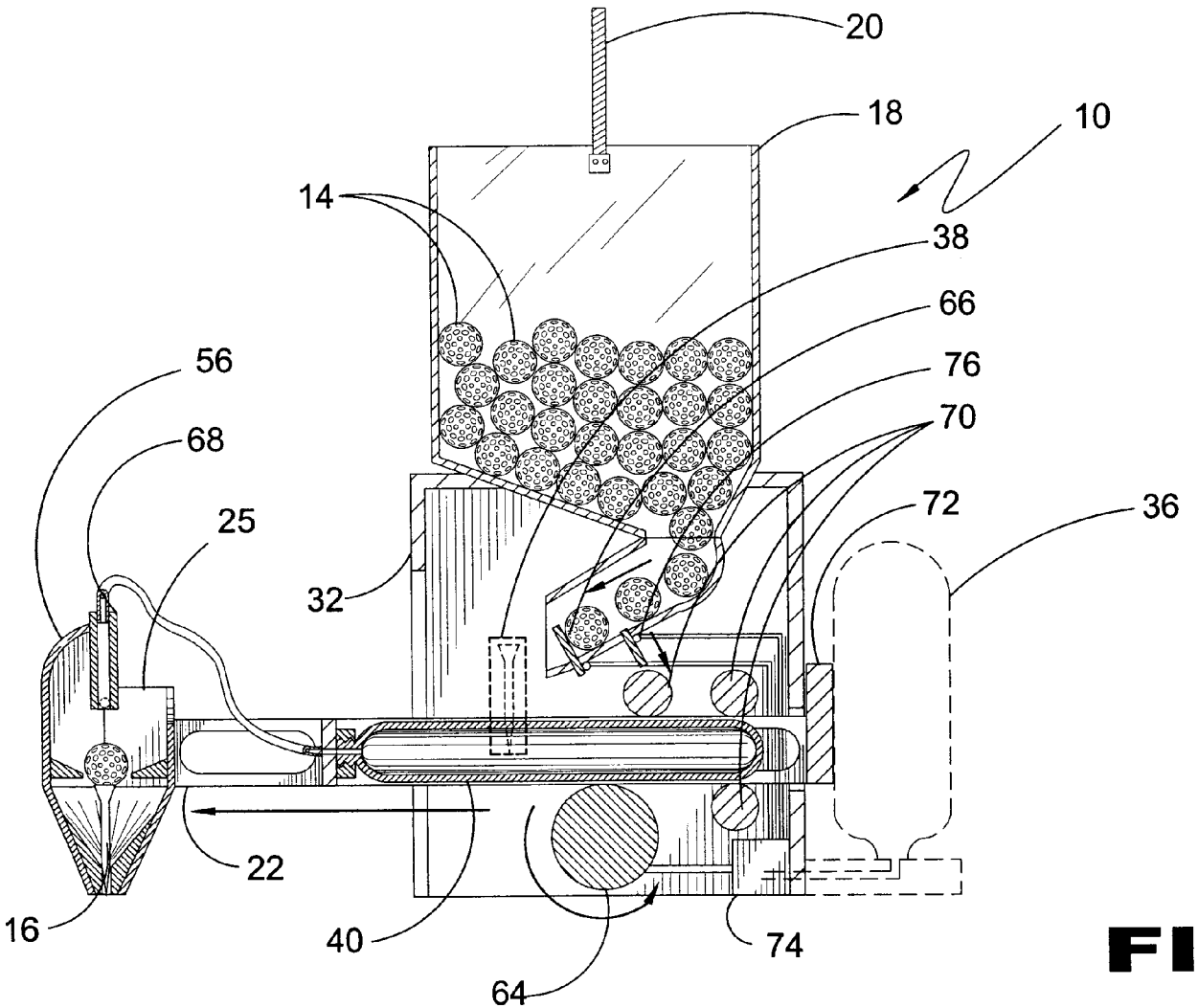
FIG. 7 is a cut away view of the present invention.

Turning to FIG. 7, shown therein is a cut away view of the present invention 10. Shown is the present invention with the placement arm 22 in position to fire the air gun 68 to inject the tee 16 and golf ball 14 into the ground. During this procedure the pneumatic motor 64 pushes the arm 22 outward to the desired position, in the meanwhile the load gate 76 is opened to load the next golf ball 14 into a position where it may be released by the release gate 66, into aperture 25 of the placement unit 56 when the placement arm 22 retracts after the ball has been placed onto the ground or injected into the ground with a tee 16. Other elements previously disclosed are also shown.

Figure 8:
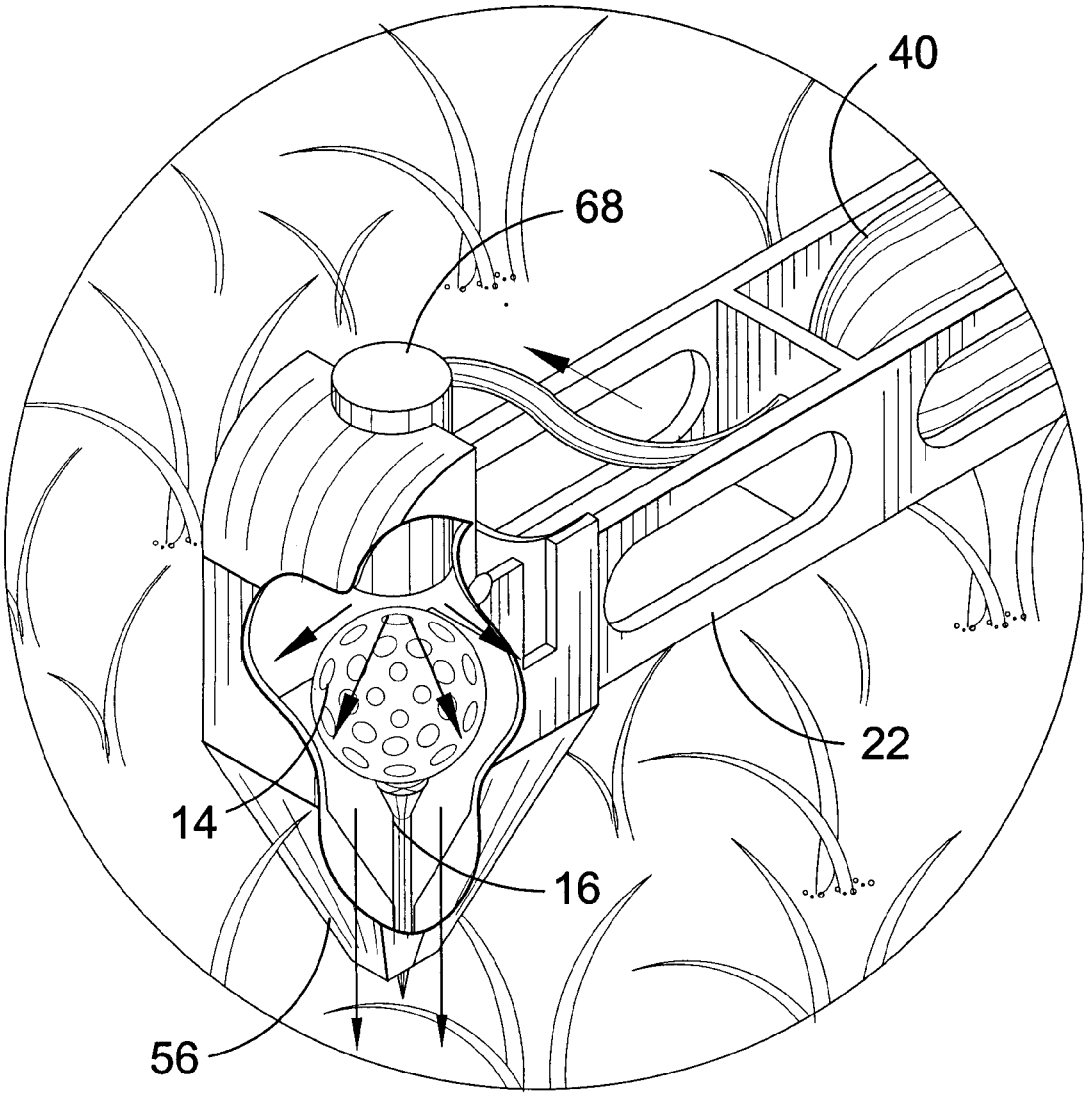
FIG. 8 is a perspective view of the present invention.

Turning to FIG. 8, shown therein is a perspective view of the present invention. Shown is the present invention injecting a golf ball 14 and tee 16 into the ground by allowing air pressure to be exerted on top of the ball 14 so that it may push the tee 16 into the ground while remaining situated there upon. Other elements previously disclosed are also shown.

Figure 9:
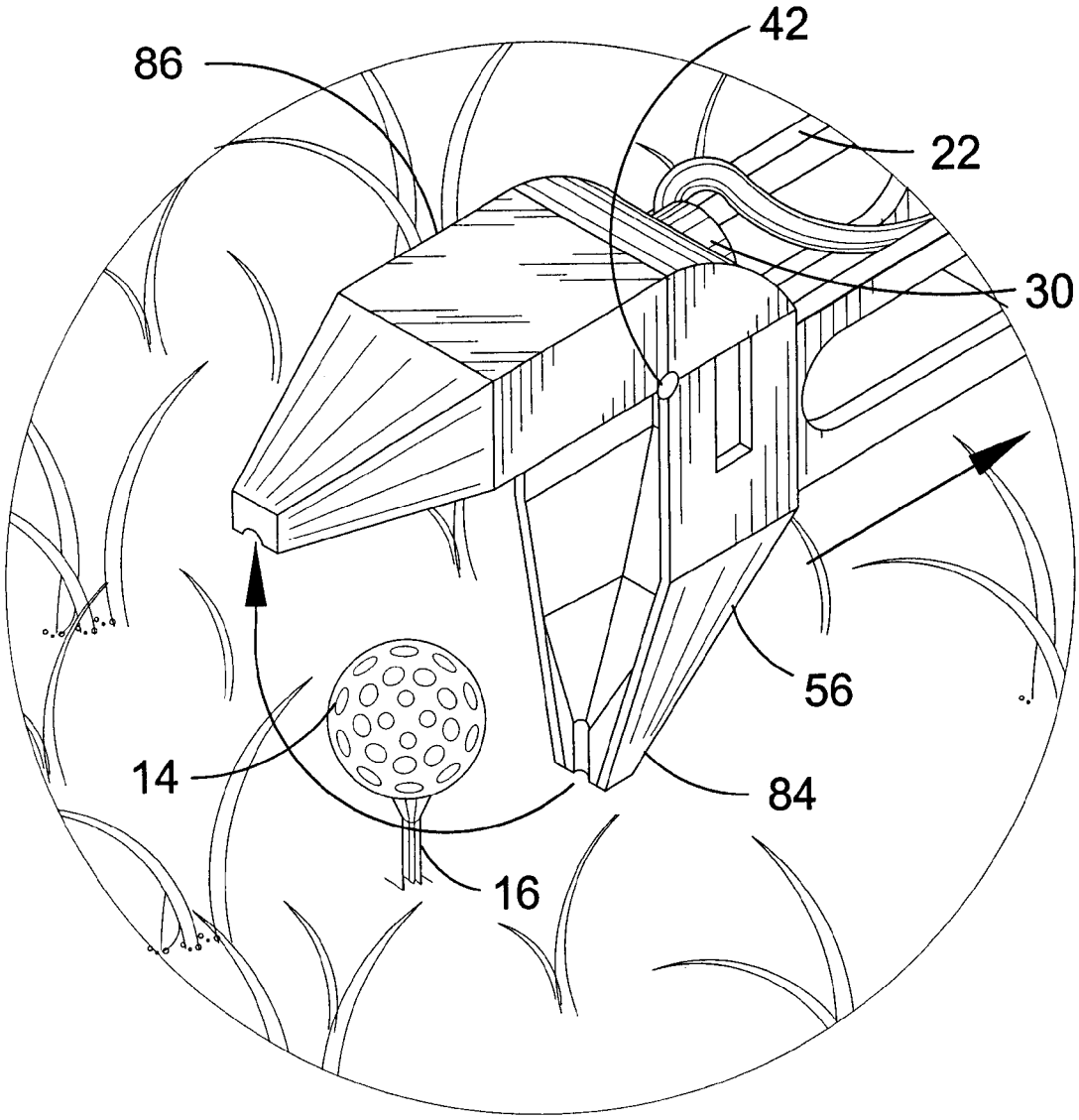
FIG. 9 is a perspective view of the present invention.

Turning to FIG. 9, shown therein is a perspective view of the present invention. Shown is the present invention's placement arm 22 having a first, fixed member 84 and a second, retractable member 86 with pneumatic hinge 42 to provide a system wherein after injection of the tee 16 and golf ball 14 or placement of the golf ball are finished, applied air pressure within the placement unit 56 forces the retractable member open for a long enough time to allow the placement arm 22 to retract and clear the golf ball 14 and tee 16 undisturbed. Air gun 30 is also shown disposed on the top of retractable member 86.

Figure 10:
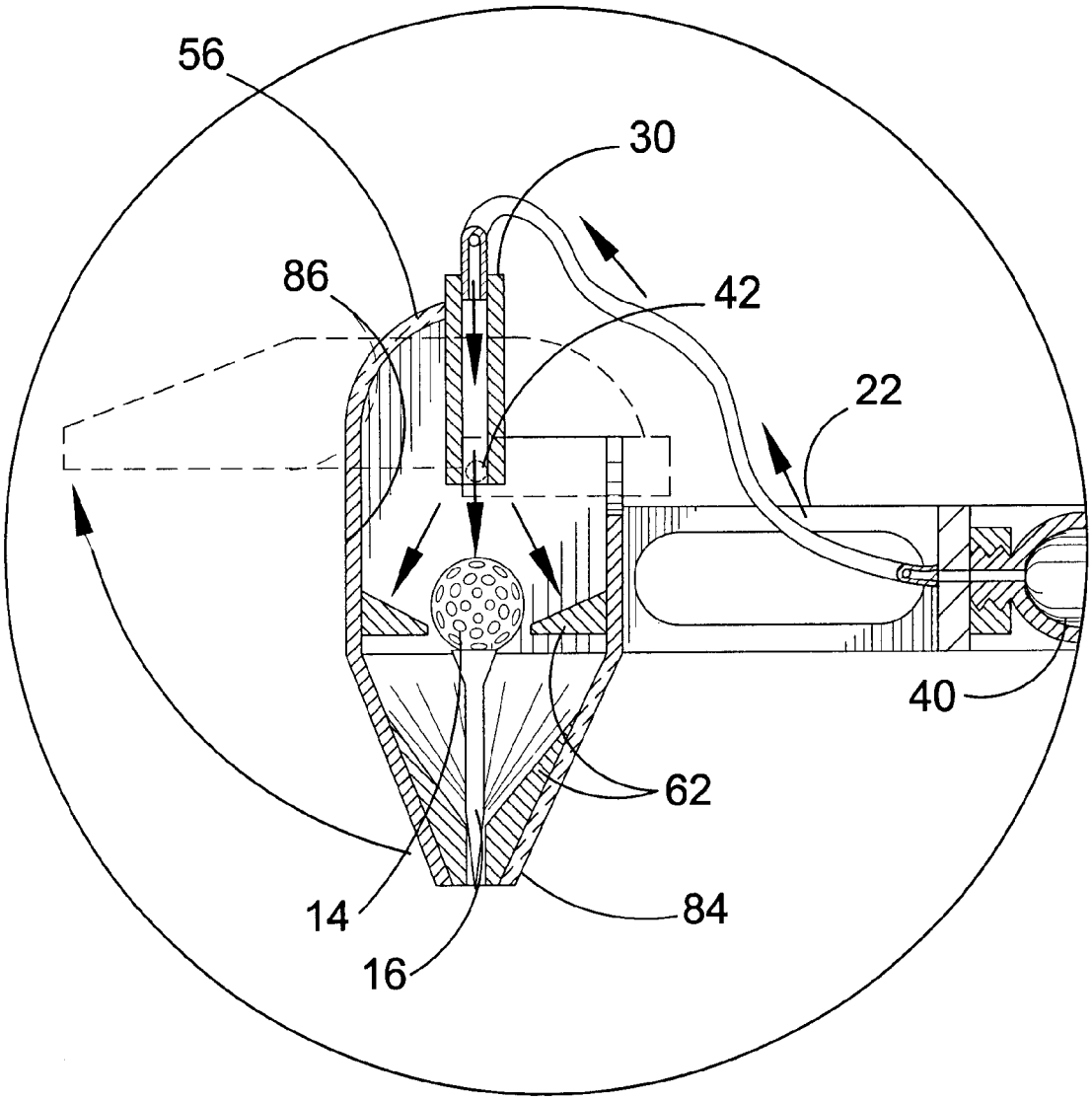
FIG. 10 is a sectional view of the present invention.

Turning to FIG. 10, shown therein is a sectional view of the present invention. Shown is the present invention's placement arm 22 and placement unit 56 having the air gun 30 firing with pressure from the arm pressure tank 40 to cause the golf ball 14 and tee 16 to be injected into the ground. The pressure from the air gun 30 causes the pneumatic hinge 42 to operate in a manner that allows the retractable member 86 of the placement unit 56 to open for a duration of time long enough to allow the golf ball 14 and tee 16 to be undisturbed when the placement arm 22 is retracting into the housing. Other elements previously disclosed are also shown.

Figure 11:
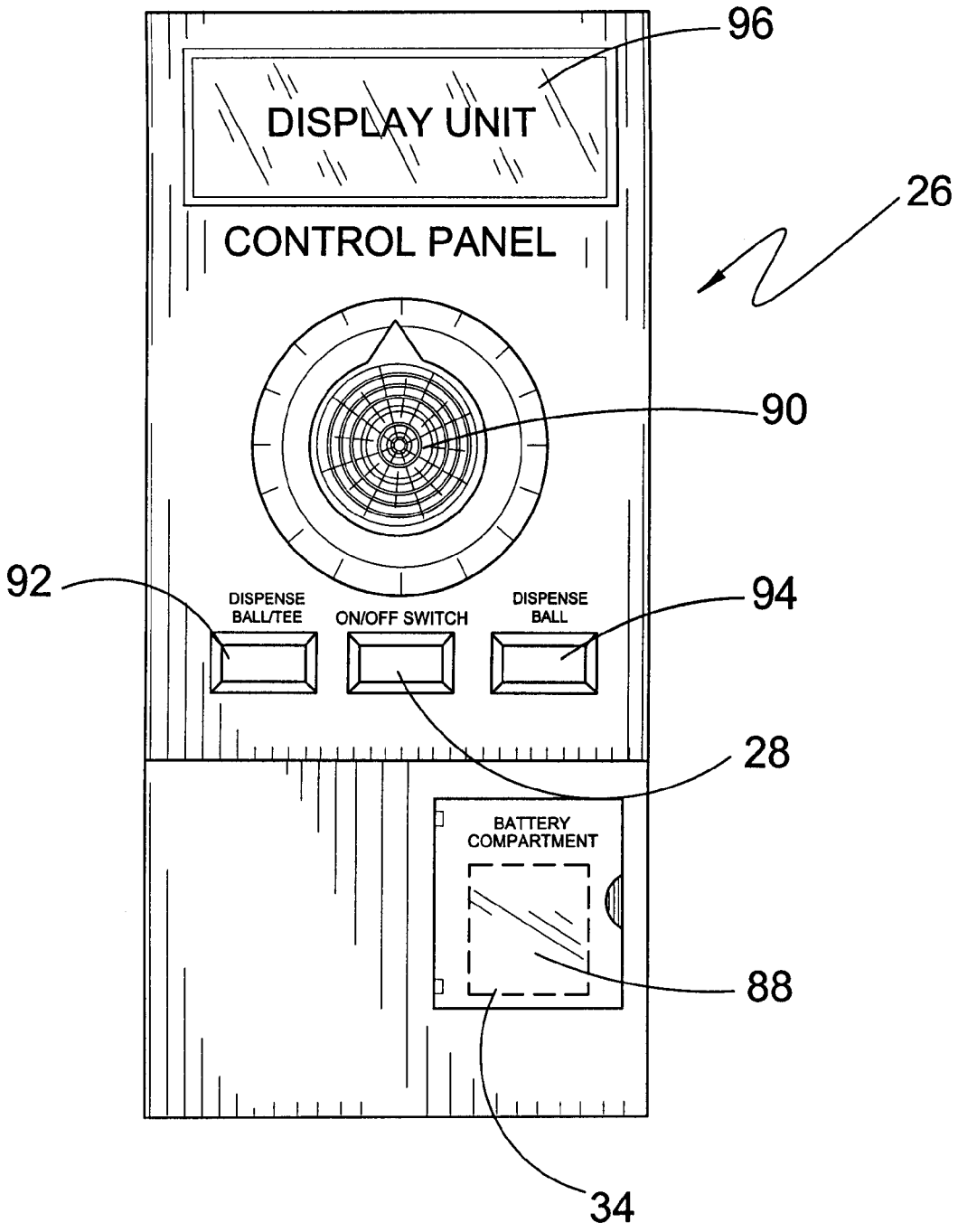
FIG. 11 is a frontal view of the control panel of the present invention.

Turning to FIG. 11, shown therein is a frontal view of the control panel 26 of the present invention. Shown is the control panel of the present invention and the battery compartment 34 and battery 88 power source of the present invention. Also shown are the timer 90, the on/off switch 28, the dispense ball/tee switch 92, and the dispense ball only switch 94, and display 96.

Figure 12:
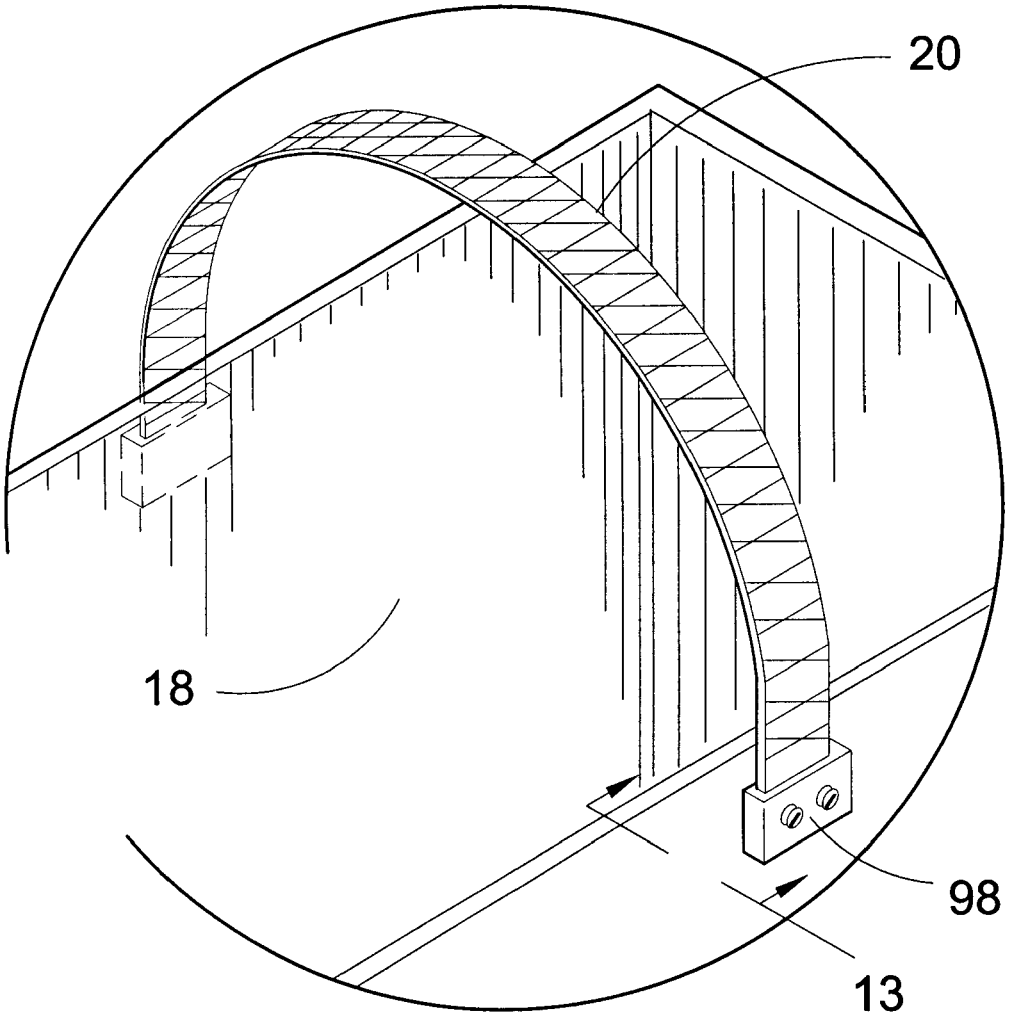
FIG. 12 is a view of the carrying strap of the present invention.

Turning to FIG. 12, shown therein is a view of the carrying strap of the present invention. Shown is the carrying strap 20 and attachment hardware 88 of the present invention and ball storage unit 18.

Figure 13:
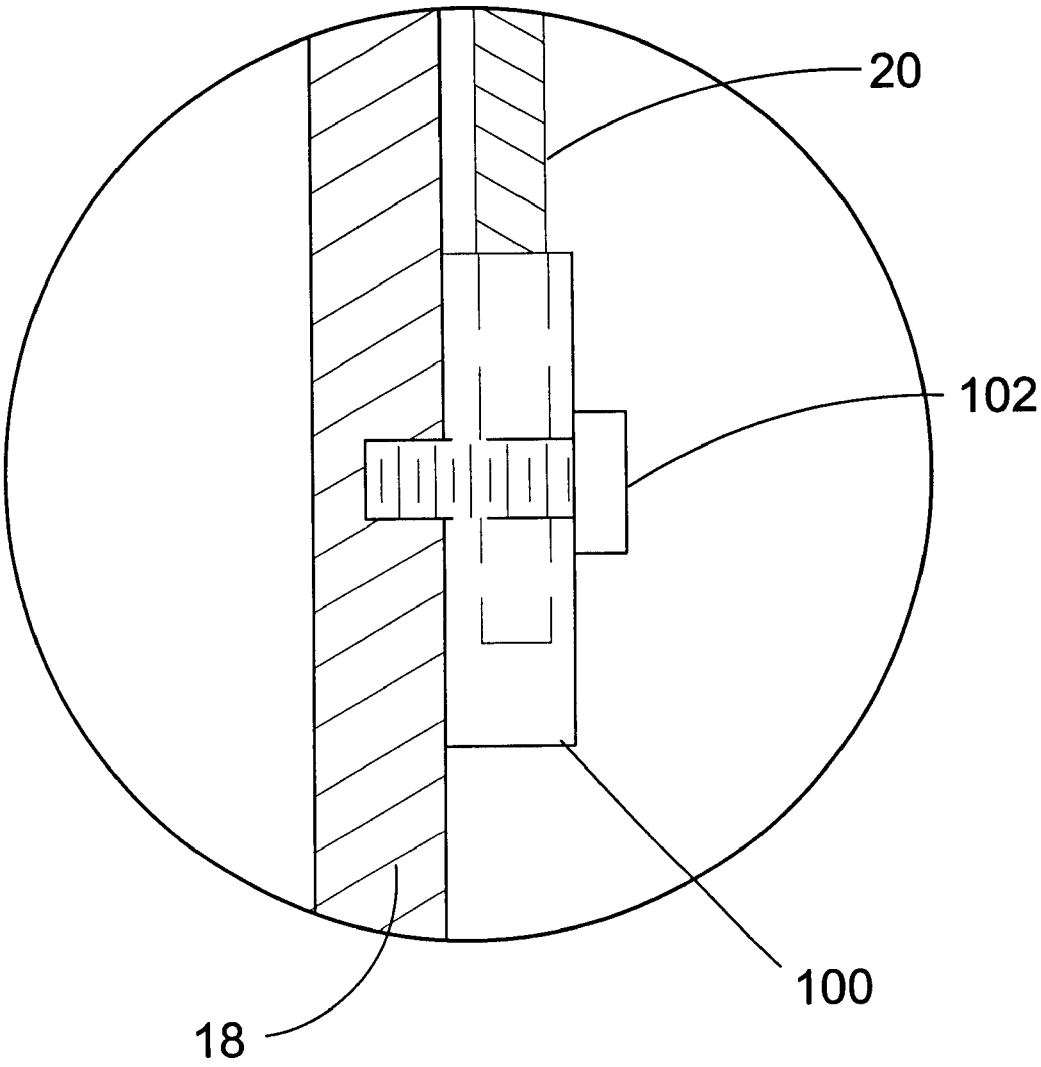
FIG. 13 is a detail view of the carrying strap of the present invention.

Turning to FIG. 13, shown therein is a detail view of the carrying strap 20 of the present invention. Shown is the carrying strap 20 of the present invention and its mounting hardware being a retainer 100 with screw 102 along with ball storage unit 18.

Figure 14:
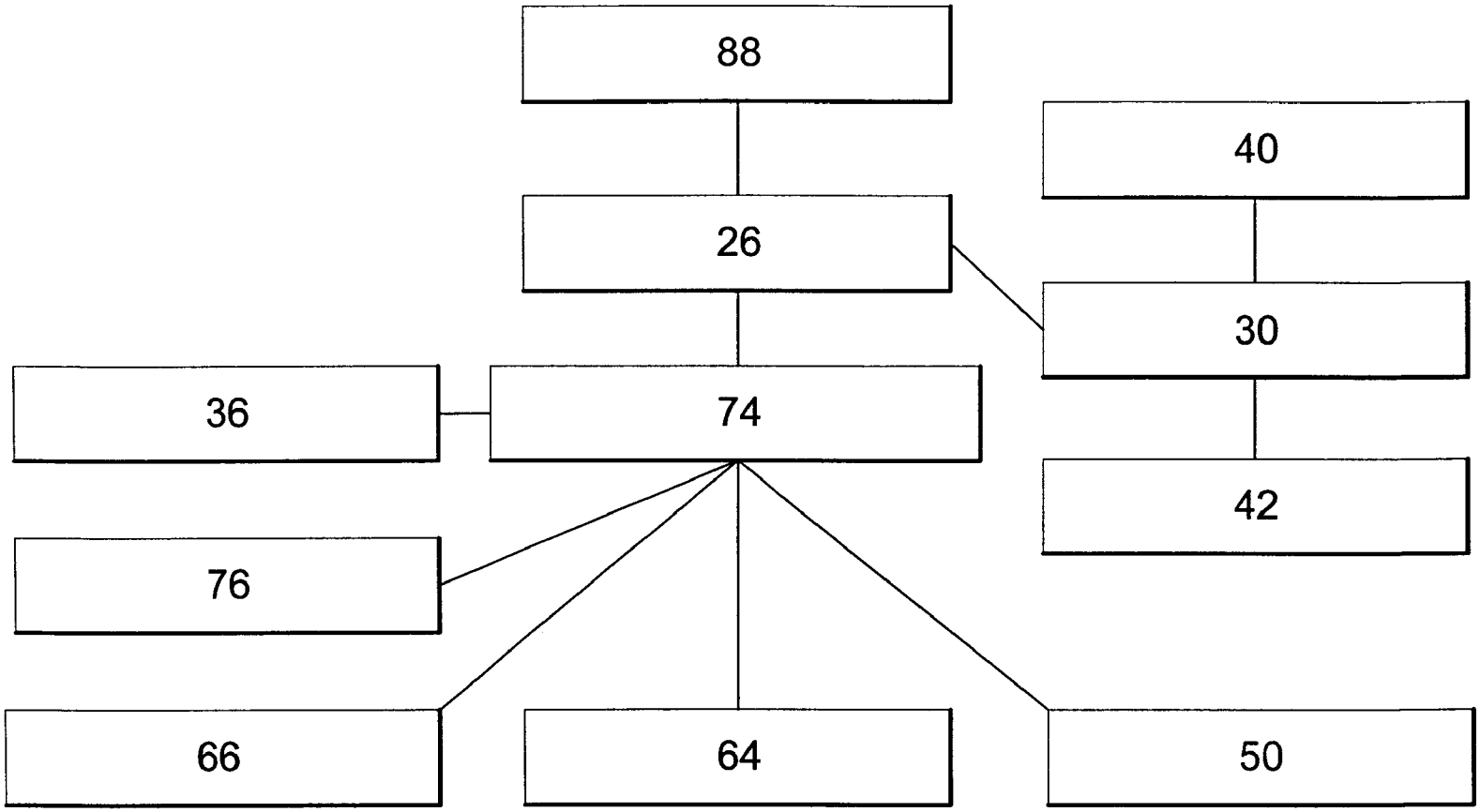
FIG. 14 is a flow chart of the present invention.

Turning to FIG. 14, shown therein is a flow chart of the present invention. Shown is a flow chart showing the relationships and order of operations between the various components and systems functioning of the present invention.

What is claimed to be new and desired to be protected by Letters Patent is set forth in the appended claims.

1. An apparatus for positioning a golf ball or tee on the ground, comprising:

a) a housing, said housing having a top portion, a bottom portion, a front, a rear, and a pair of sides;

b) a hopper for containing a plurality of golf balls, said hopper disposed on said top portion of said housing;

c) means for a downwardly extending conduit disposed on said hopper to permit a golf ball to be delivered by gravity from said hopper to a placement unit;

d) means for a placement arm whereby said placement arm reciprocates to deliver a ball and/or tee for positioning on the ground;

e) means for a placement unit whereby a golf ball and/or tee can be positioned on the ground;

f) means for a tee clip disposed internal said housing whereby a tee can be delivered to said means for a placement unit;

g) means for a source of air pressure disposed on said housing whereby pneumatic pressure is supplied to operate the apparatus;

h) means for a control panel disposed on said housing whereby the apparatus is controlled; and, i) means for a power source disposed on said housing whereby power is supplied to the apparatus.

2. The apparatus of claim 1, wherein said means for a source of air pressure comprises a main air pressure tank disposed on said housing and an arm air pressure tank disposed on a placement arm.

3. The apparatus of claim 2, wherein said means for a placement arm comprises:

a) an elongated placement arm wherein said placement arm reciprocates in the horizontal plane internal said housing, said arm reciprocating from said first side to said second side of said housing, said placement arm having a first and a second end;

b) a plurality of arm guides disposed in a spaced apart manner along said placement arm to permit the placement arm to reciprocate thereon;

c) a pneumatic motor attached to said placement arm to permit the placement arm to reciprocate;

d) a main air pressure tank for supplying air for operating said placement arm;

e) a pressure distribution and conduit for delivering air from said main air pressure tank to said pneumatic motor; and, f) an arm stop disposed on said second end of said placement arm to stop the placement arm.

4. The apparatus of claim 3, wherein said means for a placement unit comprises:

a) a placement unit disposed on said first end of said placement arm to permit placement of a golf ball and/or tee on the ground;

b) a fixed guide disposed on said placement unit forming a first member of the golf ball and/or tee guide, said fixed guide having a top portion having an aperture therein;

c) a retractable guide disposed on said placement unit forming a second member of the golf ball and/or tee guide, said retractable guide having a top portion;

d) a pneumatic hinge connecting said fixed guide and said retractable guide to permit the retractable guide to be opened away from the fixed guide;

e) an arm air pressure tank disposed on said placement arm for providing air to said placement unit;

f) an air gun disposed on said top of said retractable guide to provide air pressure to position the golf ball and/or tee on the ground; and, g) a conduit for connecting said air gun to said arm air pressure tank.

5. The apparatus of claim 4, wherein said means for a downwardly extending conduit comprises:

a) a conduit for delivering a golf ball by gravity from said hopper to said aperture of said fixed guide;

b) a load gate and a release gate disposed internal said conduit for delivering a golf ball to said aperture of said fixed guide;

c) at least one tension spring disposed on each of said load gate and said release gate to bias said load gate and said release gate to a normally closed position;

d) a pressure valve and catch disposed on each of said load gate and said release gate for biasing said load gate and said release gate to an open position when air pressure is supplied; and, e) a conduit for delivering air from said air distribution to each of said pressure valves to permit operation of the pressure valve.

6. The apparatus of claim 5, wherein said means for a tee clip comprises:

a) an elongated tee housing, said tee housing having a first end and a second end said first end disposed above said fixed guide of said placement unit;

b) a guide track disposed internal said tee housing, said guide track running longitudinally along said tee housing to permit movement of a tee along the guide track;

c) a pressure spring disposed on said second end of said tee housing to bias the tees toward said first end of said tee housing;

d) a stop block disposed on said first end of said tee housing to stop the movement of the tees;

e) a tee air injection valve disposed on said first end of said tee housing to permit air pressure to force a tee downward into said fixed guide of said placement unit; and, f) a conduit for delivering air from said air distributor to said tee air injection valve.

7. The apparatus of claim 6, wherein said means for a control panel comprises:

a) a control panel disposed on said housing;

b) a timer disposed on said control panel to permit the timed operation of the apparatus;

c) a display unit disposed on said control panel for displaying information regarding the operation of the apparatus;

d) an on/off switch disposed on said control panel;

e) a dispense ball switch disposed on said control panel to permit only a ball to be dispensed from the apparatus; and, f) a dispense balutee switch disposed on said control panel to permit a ball and a tee to be dispensed from the apparatus.

8. The apparatus of claim 7, wherein said means for a power source comprises:

a) a battery; and, b) a battery compartment disposed on said housing for containing said battery.

9. The apparatus of claim 8, further comprising a handle being disposed on said top portion of said housing to permit the housing to be moved about.

10. The apparatus of claim 9, said handle further comprising a strap.

11. The apparatus of claim 10, said handle further comprising means for attaching said handle to said housing.

12. The apparatus of claim 11, wherein said means for attaching said handle to said housing comprises a strap retainer disposed on said ends of said strap and a screw for attaching said strap retainer to said housing.

* * * * *